US006005538A

United States Patent [19]

Hoekstra

[11] Patent Number: 6,005,538

[45] Date of Patent: Dec. 21, 1999

[54] VACUUM FLUORESCENT DISPLAY DRIVER

[75] Inventor: Eric J. Hoekstra, Holland, Mich.

[73] Assignee: Donnelly Corporation, Holland, Mich.

[21] Appl. No.: 08/989,092

[22] Filed: Dec. 11, 1997

[51] Int. Cl.[6] ..... G09G 3/06

[52] U.S. Cl. ..... 345/47; 345/33; 345/34; 345/42; 315/307

[58] Field of Search ..... 345/33, 34, 41, 345/42, 47, 45, 46, 474, 475; 315/167, 168, 169.1, 169.3, 307, 291, 94, 105

[56] References Cited

U.S. PATENT DOCUMENTS

| | | | |
|---|---|---|---|
| 4,158,794 | 6/1979 | Sandler | 315/169.1 |
| 4,209,729 | 6/1980 | McElroy | 315/169.1 |
| 4,488,089 | 12/1984 | Shota | 315/106 |
| 5,099,178 | 3/1992 | Bozzer et al. | 315/169.1 |
| 5,442,259 | 8/1995 | Lameris et al. | 315/169.3 |
| 5,703,441 | 12/1997 | Steigerwald et al. | 315/307 |
| 5,808,419 | 9/1998 | Sunaga et al. | 345/47 |

*Primary Examiner*—Richard A. Hjerpe
*Assistant Examiner*—Duc Dinh
*Attorney, Agent, or Firm*—Van Dyke, Gardner, Linn & Burkhart, LLP

[57] ABSTRACT

A vacuum fluorescent display driver and method for driving a vacuum display device includes a segment selecting circuit which selectively applies a potential of a particular polarity to a segment to illuminate that segment and a grid driver circuit which applies a potential of that polarity to the grid in order to illuminate the device. A filament supply supplies a current to the filament during a first portion of a duty cycle in order to heat the filament and applies a potential of polarity opposite to that applied to the filament during a second portion of the duty cycle in order to produce a potential between the filament, the grid, and any segment which is selected sufficient to illuminate the selected segments. The driver is especially adapted for use with a microcomputer particularly in a vehicle display mirror, such as a compass mirror.

58 Claims, 7 Drawing Sheets

VACUUM FLUORESCENT DISPLAY DRIVER

BACKGROUND OF THE INVENTION

This invention relates generally to drivers for electronic display devices and, in particular, to a display driver for a vacuum fluorescent display. The invention finds application in vehicle electronic systems, such as display mirrors, as well as non-automotive applications. Advantageously, the present invention facilitates the use of vacuum fluorescent displays in battery operated devices.

A vacuum fluorescent display is similar in structure to a triode vacuum tube. The display includes a filament which must be kept hot in order to emit electrons and a grid which controls the flow of electrons from the filament to one or more phosphorous-coated segments. When a voltage differential of sufficient magnitude exists between the filament and a particular segment, the segment phosphors thereby emitting light. The grid typically determines whether an entire digit is ON or OFF and may also provide an intensity control in order to control the intensity of the digit. Alternatively, the intensity level of the digit may be controlled by Pulse-Width Modulation (PWM) of the signal turning on particular segments of the display.

One particular type of driver 10 for a vacuum display 12 (one digit only of which is shown in FIG. 1) requires a power supply 14 which produces both a positive polarity voltage, such as +5 volts, and an opposite polarity voltage, such as −7 volts. A microcomputer 16 having a built-in driver has output lines 18 connected directly with individual segments 20*a*–20*g* of display 12. Microcomputer 16 additionally produces an output 22 in order to operate grid 24. Filament 26 of display 12 is supplied with approximately 1 volt from the negative terminal of power supply 14. This is accomplished by supplying −7 volts to one terminal of the filament and −8 volts to the opposite terminal for a voltage drop of 1 volt. As long as grid 24 is maintained at +5 volts, any segment 20*a*–20*g* driven to +5 volts by microcomputer 16 is lit because of approximately a 12-volt differential between each such segment and filament 26. Non-lit segments are driven to −7 volts which produces no voltage differential between that segment and the filament. When grid 24 is at +5 volts, the digit is operable. When microcomputer 16 drives grid 24 to −7 volts, the entire digit is dark.

The difficulty with display driver 10 is that it requires a complex bipolar (3 output) power supply. Many systems, such as vehicular electrical supply systems, supply power at a single polarity typically between +9 volts DC and +18 volts DC (+12 volts DC nominal). Accordingly, circuitry to convert a unipolar power source to bipolar power supply adds extra cost and complexity to the system.

An alternative prior art vacuum fluorescent display driver circuit 30 is provided which is compatible with the unipolar nature of a vehicle power source. Display driver circuit 30 includes a microcomputer 32 which is operable from a +5 volt source and a separate driver circuit 34 which receives a coded output 36 from microcomputer 32 and decodes the output to provide appropriate signals via output lines 38 to display 12. Driver circuit 34 is operated from +12 volts which is of the same polarity as the source for microcomputer 32. Accordingly, both microcomputer 32 and display driver 30 are compatible with vehicular electrical supply systems. In order to produce the necessary voltage differentials to illuminate the various segments, driver circuit 34 switches output lines 38 to +12 volts in order to light a segment and to zero volts in order to cause a segment to remain dark. Grid 24 is supplied with +12 volts in order to switch the digit ON and at zero volts in order to turn the digit OFF. Driver circuit 34 supplies a +12 volt output which is used to heat filament 26. In order to supply the appropriate power to the filament, it is necessary to drop the 12 volts to 1 volt using a resistor R in series with filament 26. The other terminal of filament 26 is connected to ground. Therefore, filament 26 is close to zero volts. When a particular segment is supplied with +12 volts, a 12-volt differential exists between that segment and the filament in order to light the segment.

Although display driver 30 is compatible with vehicular supply voltages, it is not without its difficulties. A separate driver circuit is required in order to convert output voltages of the microcomputer to voltage levels sufficient to operate the vacuum display device. This adds cost and complexity to the circuit. Also, the necessity for a resistor to drop the supply voltage for the filament from +12 volts to +1 volt dissipates a significant amount of power resulting in a significant power consumption for the display driver. For example, display driver 30 requires approximately 150 milliamps at 12 volts DC.

SUMMARY OF THE INVENTION

The present invention provides a display driver for a vacuum fluorescent display which, for the first time, drives a vacuum florescent display from a unipolar source, preferably the ignition system or battery of a vehicle when the display being driven is a vehicular display, without the necessity for a separate display driver integrated circuit. This allows the display to be driven directly from the output to a microprocessor or a microcomputer. Importantly, this can be accomplished in a manner which requires a significantly reduced energy consumption compared with conventional unipolar vacuum fluorescent display drivers.

A vacuum fluorescent display driver and method for driving a vacuum fluorescent display device according to an aspect of the invention includes providing a segment selecting circuit which selectively applies electrical potential of a particular polarity to a segment to illuminate that segment and a grid driver circuit which applies electrical potential of that polarity to the grid in order to illuminate the device. A filament supply supplies a current to the filament during a first portion of a duty cycle in order to heat the filament and applies an electrical potential of an opposite polarity to the filament during a second portion of the duty cycle in order to produce an electrical potential between the filament, the grid, and any segment which is selected sufficient to illuminate the selected segments.

A display mirror system according to another aspect of the invention includes a reflective element having a reflective surface, a housing for the reflective element and a vacuum fluorescent display device for displaying information. The system further includes a microcomputer having an input port for receiving information to be displayed and output ports connected with the segments of the display and selectively activated to illuminate particular segments of the display device. A grid supply applies an electrical potential to the display grid. A filament supply circuit under the control of the microcomputer heats the filament and drives the filament to a negative polarity in order to produce an electrical potential between the filament, the grid and activated segments sufficient to illuminate the selected segments. The display mirror system may be a compass mirror which includes a compass circuit which senses vehicle heading and displays heading on the display device.

Thus, it is seen that the present invention provides a vacuum fluorescent display driver which is operable from a unipolar source without the necessity for a separate display driver integrated circuit thereby allowing the outputs to the microcomputer to directly drive the vacuum fluorescent display. Because the invention is operable from a unipolar power source, the requirement for a bipolar power supply is eliminated. This also reduces both the complexity and cost of the display driver. Also, a vacuum fluorescent display driver according to the invention has an approximately five-fold reduction in power consumption over conventional drivers. As a result, a display driver, according to the invention, for the first time, makes feasible the use of vacuum fluorescent displays in handheld battery operated devices which currently utilize liquid crystal displays or the like.

These and other objects, advantages and features of this invention will become apparent upon review of the following specification in conjunction with the drawings.

DESCRIPTION OF THE PREFERRED EMBODIMENT

Figure 1:
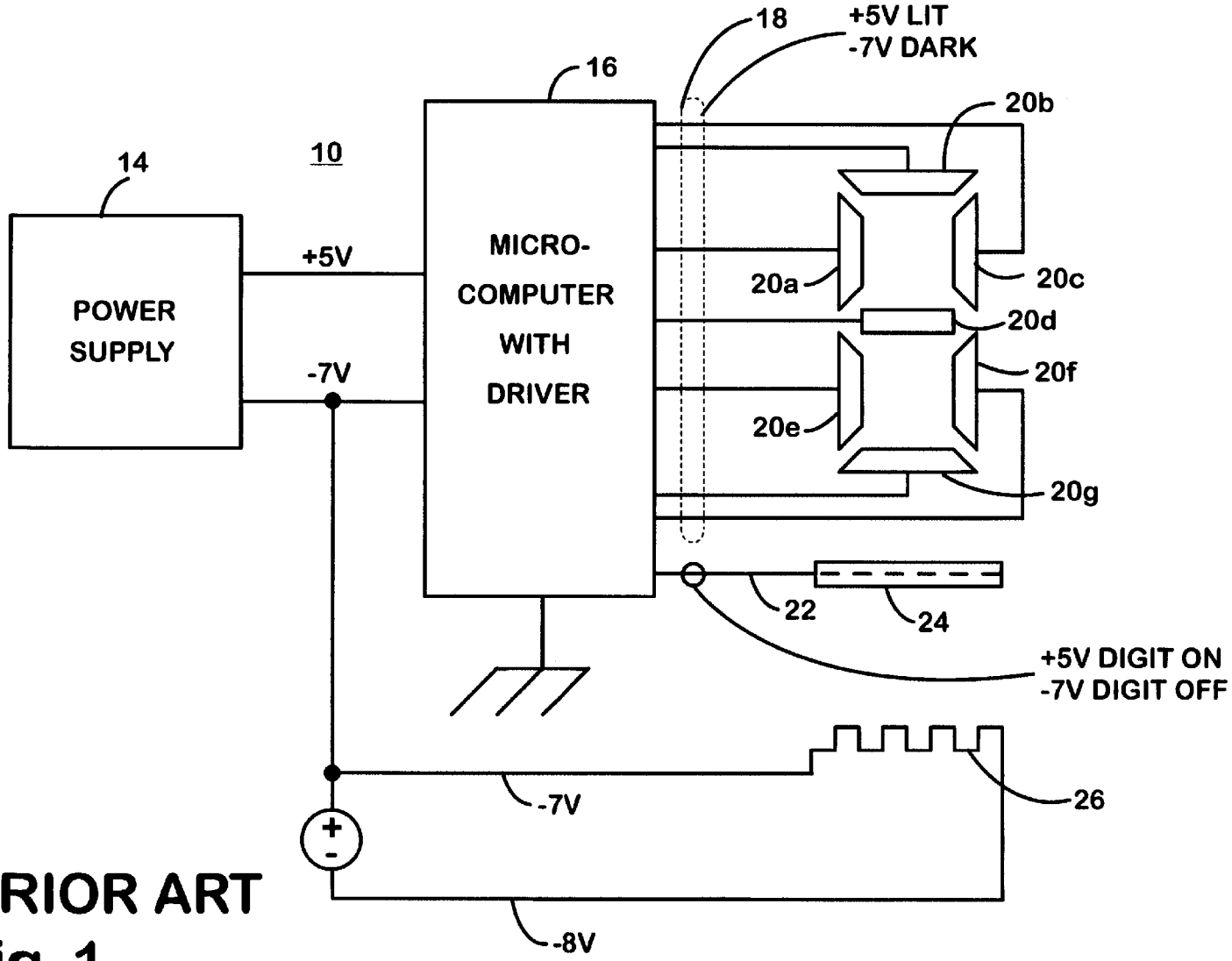
PRIOR ART Fig. 1
FIG. 1 is a block diagram of a prior art vacuum fluorescent display driver circuit.
Figure 2:
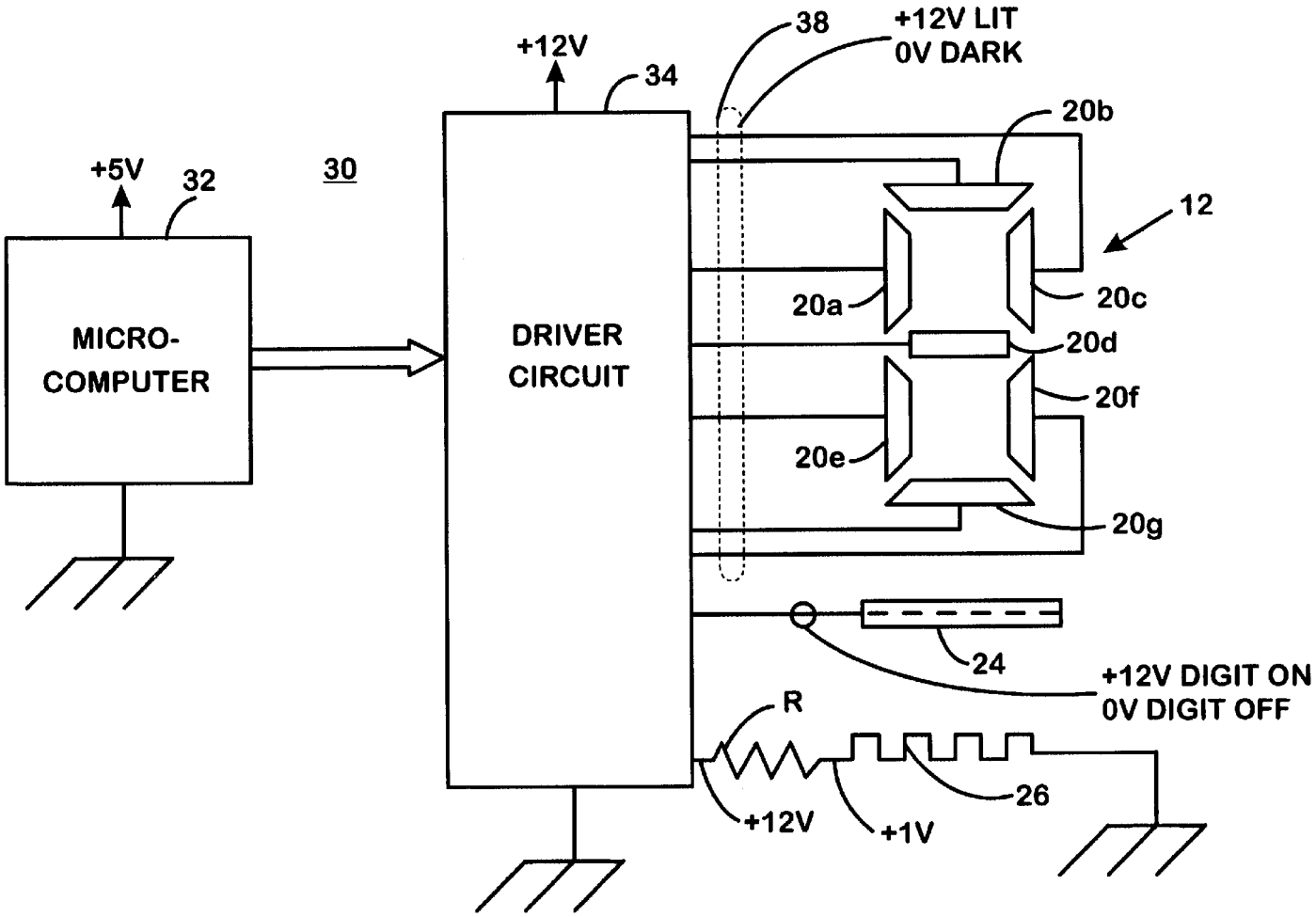
PRIOR ART Fig. 2
FIG. 2 is a block diagram of another prior art vacuum fluorescent display driver circuit.
Figure 3:
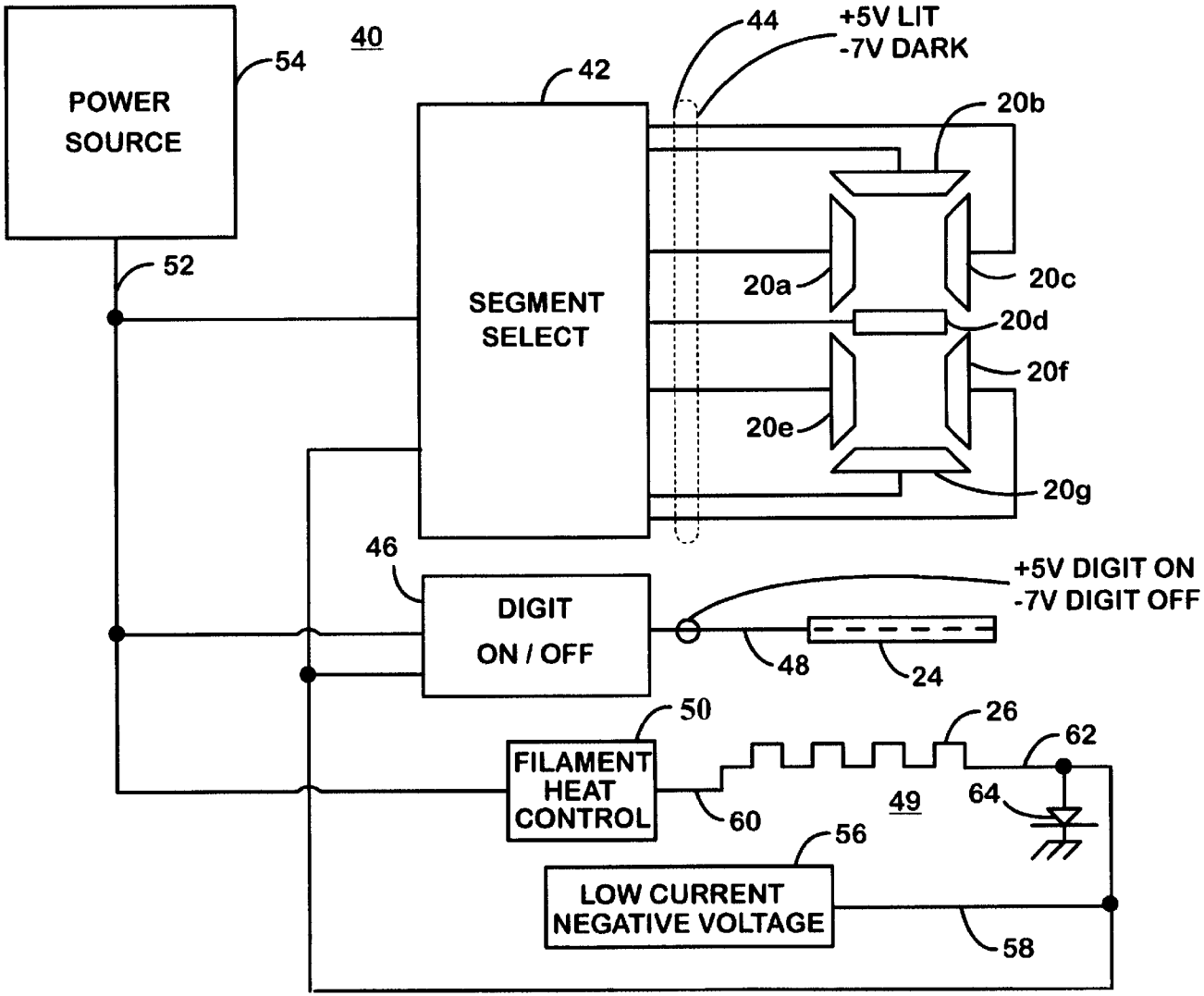
FIG. 3 is a block diagram of a vacuum fluorescent display driver circuit according to the invention.

Referring now specifically to the drawings, and the illustrative embodiments depicted therein, a display driver 40 according to the invention includes a segment select circuit 42 having output lines 44 connected with segments 20*a*–20*g* of display 12, a digit ON and OFF control 46 for applying a voltage through its output 48 to grid 24 and a filament supply circuit 49 for supplying power to filament 26. Segment select circuit 42, digit ON/OFF circuit 46 and filament supply circuit 49 are all supplied with power on a line 52 from a unipolar power source 54 which may be vehicle ignition voltage, battery voltage, or the like. Filament supply circuit 49 is made up of a filament heat control circuit 50 for heating the filament and a low current negative voltage circuit 56 which is connected at 58 with filament 26 for the purpose of applying a negative voltage to the filament in order to provide a sufficient voltage differential between the filament and selected ones of the display segments 20*a*–20*g* in order to illuminate the selected segments in a manner which will be described below.

Filament heat control circuit 50 has an output 60 applied to filament 26 whose opposite terminal 62 is connected through a diode 64 to ground. Filament heat control circuit 50 applies a voltage at output 60 during a relatively minor portion of a duty cycle but of a sufficient power to heat filament 26 during that portion of the duty cycle. For example, filament heat control circuit 50 may apply a voltage at full system supply voltage, such as between approximately +5 volts DC and approximately +12 volts DC, for a period of less than approximately 50% of the duty cycle, preferably less than approximately 20% of the duty cycle, and most preferably between approximately 2% and approximately 5% of the duty cycle. Because the power applied to the filament during that portion of the duty cycle is relatively large, the filament is adequately heated. The current produced by filament heat control circuit 50 is connected through filament 26 and diode 64 to ground. During the portion of the duty cycle when the filament is being heated, the segment is OFF. Because this is a minor portion of the duty cycle, it is not substantially humanly perceived.

During the major portion of the duty cycle when filament heat control circuit 50 is off, low current negative voltage circuit 56 produces a low current negative voltage on its output 58. Because the negative voltage is applied for the major portion of the duty cycle; namely, between approximately 90% and approximately 97% of the duty cycle, the lit segments 20*a*–20*g* are visible without any noticeable flicker caused by the approximately 3% to approximately 10% of the time when the filament is not negative and thereby the segments are not illuminated. This, absent of flicker, is further facilitated by operating filament heat control circuit 50 and low current negative voltage circuit 56 at a repetition rate of at least approximately 10 kHz and preferably between approximately 20 kHz and approximately 25 kHz. Output 58 of low current negative voltage circuit 58 is also supplied to segment select circuit 42 and digit ON/OFF control circuit 46 to selectively apply the negative voltage to segments that are to remain dark in the case of segment select circuit 42 and to grid 24 when the entire display is to remain off.

Figure 8:
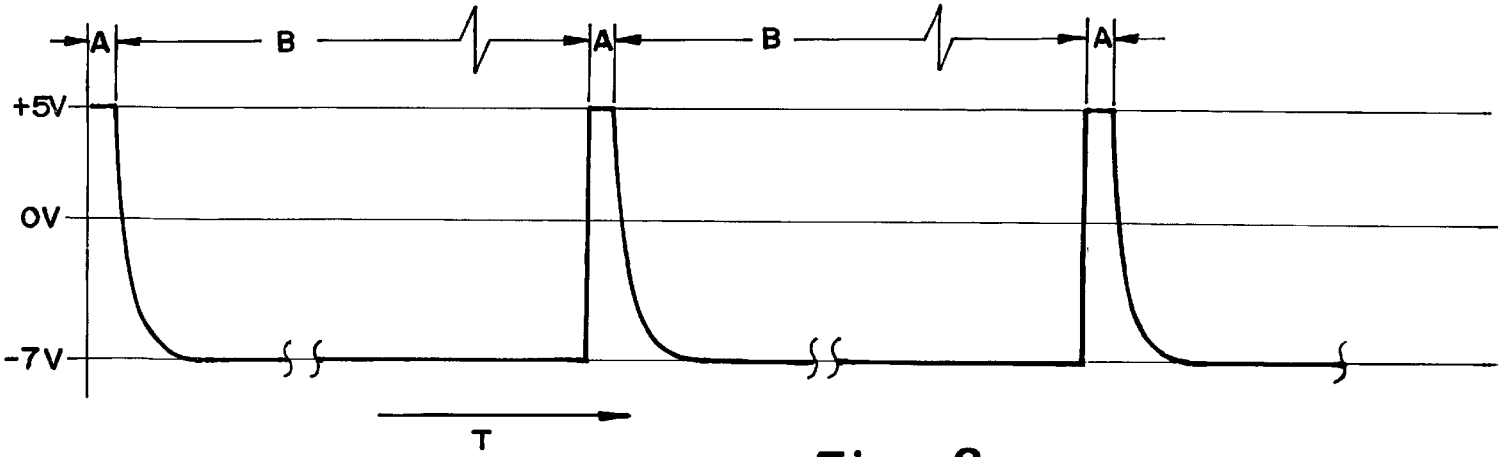
FIG. 8 is a diagram illustrating filament voltage.

The relationship between the heating of filament 26 and the driving of filament 26 to a negative voltage can be seen by reference to FIG. 8. During interval A, filament heat control circuit 50 applies a positive voltage, such as +5 volts, to terminal 60 which causes a current to flow through filament 26 and diode 64 to ground heating the filament. At the end of interval A and the beginning of interval B, filament heat control circuit 50 discontinues the supply of current to filament 26 and low current negative voltage circuit 56 applies a negative voltage through line 58 to terminal 62 of the filament causing the segments, which are driven to a +5 volts, to light. When low current negative voltage 56 applies a negative voltage to line 58, filament heat control circuit 50 is in a high impedance state and thereby does not apply a load to that signal. Furthermore, diode 64 is reverse-biased and, therefore, current does not flow through the diode to ground. Therefore, filament 26 is floating, thereby requiring a very small current from the low current negative voltage circuit 56.

Low current negative voltage circuit 56 develops a negative voltage on output 58 without the necessity for a bipolar power supply by utilizing energy stored during the interval A when filament heat control circuit 50 is applying power to filament 26. The stored energy is then released during interval B in a manner which drives line 58 negative as will be explained in more detail below. This may be accomplished by storing and discharging energy with an energy storage device, such as an inductor in an inductive "flyback" circuit, a capacitor in a capacitive bootstrap circuit, or other known techniques for voltage multiplication.

Figure 4:
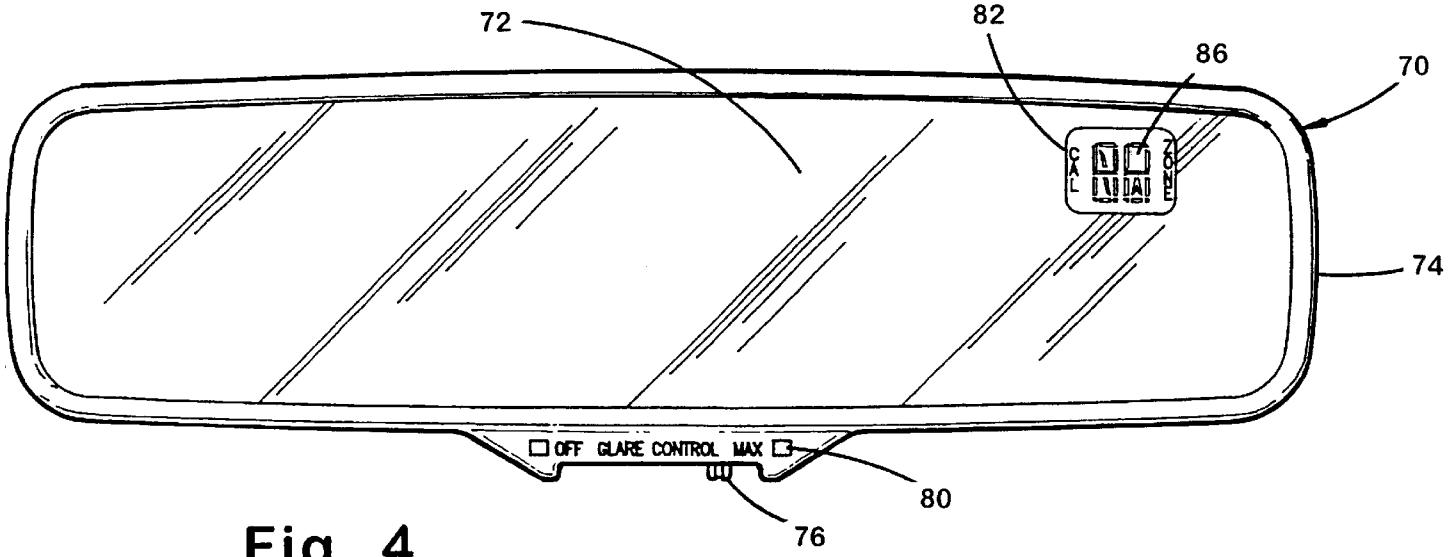
FIG. 4 is a rear elevation as viewed by a driver of a display mirror incorporating the invention.

One useful application for the present invention is in a vehicle display mirror illustrated in FIG. 4. Display mirror 70 includes a variable reflectance element 72 positioned within a housing 74. A user input control device 76 is provided in order to allow the user to adjust the sensitivity of light reflective element 72 to changes in light conditions. In order to establish the light reflectance level of light reflective element 12, a forward-facing light sensor (not shown) is provided in order to sense light conditions forward of the vehicle and a rearward-facing light sensor 80 is provided in order to sense glare-like conditions rearward of the vehicle. The variable light reflective element may be an electro-optic element, such as an electrochromic element. A reflective coating is deposited on a surface in order to reflect light incident to the light reflective element. A portion of the reflective coating is removed, or is at least partially removed, in order to establish a partially or fully transmissive portion 82. A display, such as an optical display element 86, is positioned behind the light transmissive portion 82. A light-filtering material (not shown) may be deposited in the area of transmissive portion 32 in order to provide sharp resolution of the display. Display element 86 is a vacuum fluorescent display and preferably a vacuum fluorescent indicator panel which is commercially available from numerous sources. Details of display mirror 70 are fully set forth in commonly assigned U.S. Pat. No. 5,285,060 issued to Larson et al. entitled DISPLAY FOR AUTOMATIC REARVIEW MIRROR, the disclosure of which is hereby incorporated herein by reference. Display mirror 70 may also includes a compass system 88 within housing 74 which measures vehicle heading (FIGS. 5 and 6) for display by display element 86. Various techniques are known for electronically sensing vehicle heading and may be utilized with compass mirror 70. One such compass system based on a magneto-inductive sensor is disclosed in commonly assigned U.S. Pat. No. 5,924,212, for an ELECTRONIC COMPASS, the disclose of which is, for an hereby incorporated herein by reference. Other techniques, such as flux gate magneto-capacitive and magneto-resistive techniques, are also available such as of the magneto-resistive type disclosed in commonly assigned U.S. Pat. No. 5,255,442.

Figure 5:
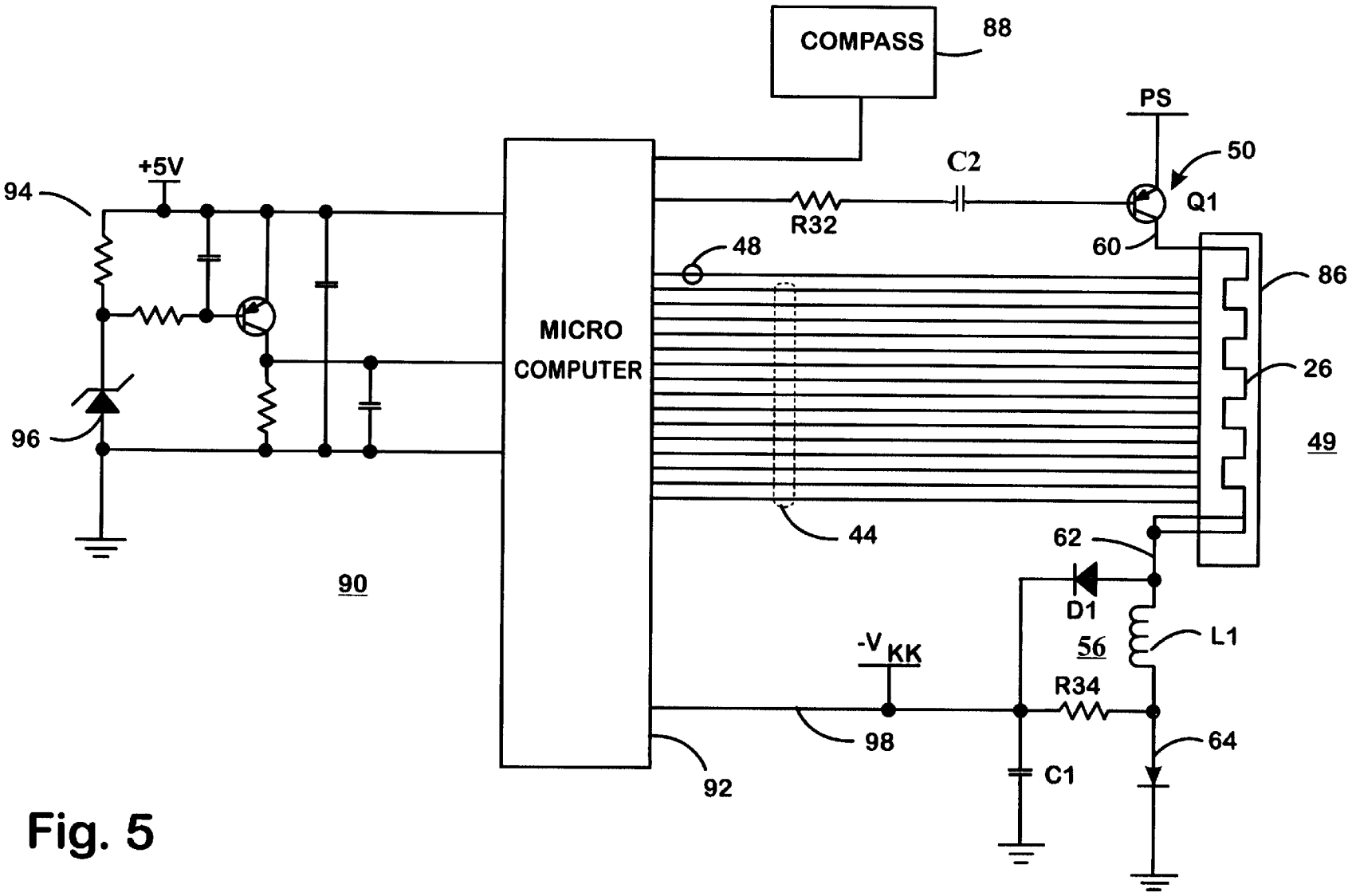
FIG. 5 is a detailed schematic diagram of a vacuum fluorescent display system according to the invention.

A display mirror, such as a compass mirror display system 90, is illustrated in FIG. 5. The compass mirror display system includes a microcomputer 92 having terminals which are preferably capable of withstanding up to 20-volt swings in both the positive and negative polarity. Such microcomputer is available from Toshiba Corporation under Model TMP87C 814 N/F. Equivalent units are marketed by various manufacturers including Sharp Corporation and Hitachi Corporation. A light-sensing circuit 94 provides an input to microcomputer 92 representing the intensity of light conditions surrounding the vehicle in which compass mirror 70 is positioned. Circuit 94 includes a photoreceptive diode 96 which is positioned within housing 70 in a manner to determine light levels utilizing the principles set forth in the Larson et al. '060 patent. Microcomputer 92 additionally receives an input from compass circuit 88 which supplies heading readings which microcomputer 92 displays on display element 86. Other functions may be performed by microcomputer 92, such as controlling reflective element 72 to a partial reflectance level utilizing the principles disclosed in commonly assigned U.S. patent application Ser. No. 08/832,380 filed Apr. 2, 1997, by Kenneth L. Schierbeek for a DIGITAL ELECTROCHROMIC MIRROR SYSTEM, the disclosure of which is hereby incorporated herein by reference.

Microcomputer 92 produces a plurality of outputs 44 which are at a positive potential when it is intended to illuminate a corresponding segment or at a negative voltage in order to darken a corresponding segment. Microcomputer 92 additionally includes an output 48, which is connected with the grid of display element 86, and is switched to a positive potential in order to turn the display ON or switch to a negative potential in order to turn the display OFF. Either of the outputs 44 or 48 could be modulated, such as by pulse-width modulation, or the like, in order to control display intensity utilizing principles disclosed in the Larson et al. '060 patent. Filament supply 49 includes a filament heat control 50 which is made up of a transistor Q1 having its emitter connected with a positive power supply which may be between approximately +5 volts DC and approximately +12 volts DC, its collector connected with terminal 60 of the display element's filament and its base connected through a resistor R32 and a capacitor C2 to an output of microcomputer 92. The other terminal 62 of the filament is connected through an inductor L1 and a diode 64 to ground. Another diode D1 connects terminal 62 with a $-V_{KK}$ line 98 which supplies an input to microcomputer 92. A capacitor C1 connects line 98 to ground and a resistor R34 connects line 98 to the junction between inductor L1 and diode D2.

The compass mirror display system 90 operates as follows. Microcomputer 92 applies a pulse to the base of transistor Q1 which applies the positive potential source connected with its emitter to the filament of display element 86. This causes a current to flow through the filament and inductor L1 and diode 64 to ground. Energy is stored in indicator L1 during this interval. After an interval equal to a minor portion of the duty cycle that does not exceed approximately 50%, preferably less than approximately 20% and most preferably in the range of between approximately 2% and approximately 5%, microcomputer 92 removes the drive from transistor Q1 which causes transistor Q1 to open. When transistor Q1 opens, the energy stored in inductor L1 causes a current to flow through diode D1 which charges capacitor C1 in a manner which produces a negative potential on $-V_{KK}$ line 98. The negative potential on line 98 couples through resistor R34 and inductor L1 to terminal 62 of the filament causing the filament to ride at a negative potential, which, in the illustrated embodiment, is nominally approximately −7 volts DC. The negative potential on line 98 is provided as an input to microcomputer 92 which utilizes that potential to apply to the output lines 44 which drive segments which are intended to be dark. Also, the negative potential $-V_{KK}$ on line 98 is applied by microcomputer 92 to output 48 if it is intended that the grid be driven negative in order to turn off the display element. Because the impedance across line 98 is exceptionally high, the voltage across C1 is capable of holding line 98 at its nominal negative potential during the major portion of the duty cycle; namely, between approximately 50% and 98% of the cycle. This cycle is repeated at a repetition rate of preferably at least approximately 10 kHz and most preferably between approximately 20 kHz and approximately 25 kHz. Because the energy stored in inductor L1 flies back to charge capacitor C1, the compass mirror display system 90 is referred to as a "flyback" configuration display driver. Capacitor C2 in series between the base of transistor Q1 and the output of microcomputer 92 provides protection to filament 26 in case the microcomputer stops for any reason with its output high. Capacitor C1 provides a time limit on the length of time transistor Q1 is on.

Figure 6:
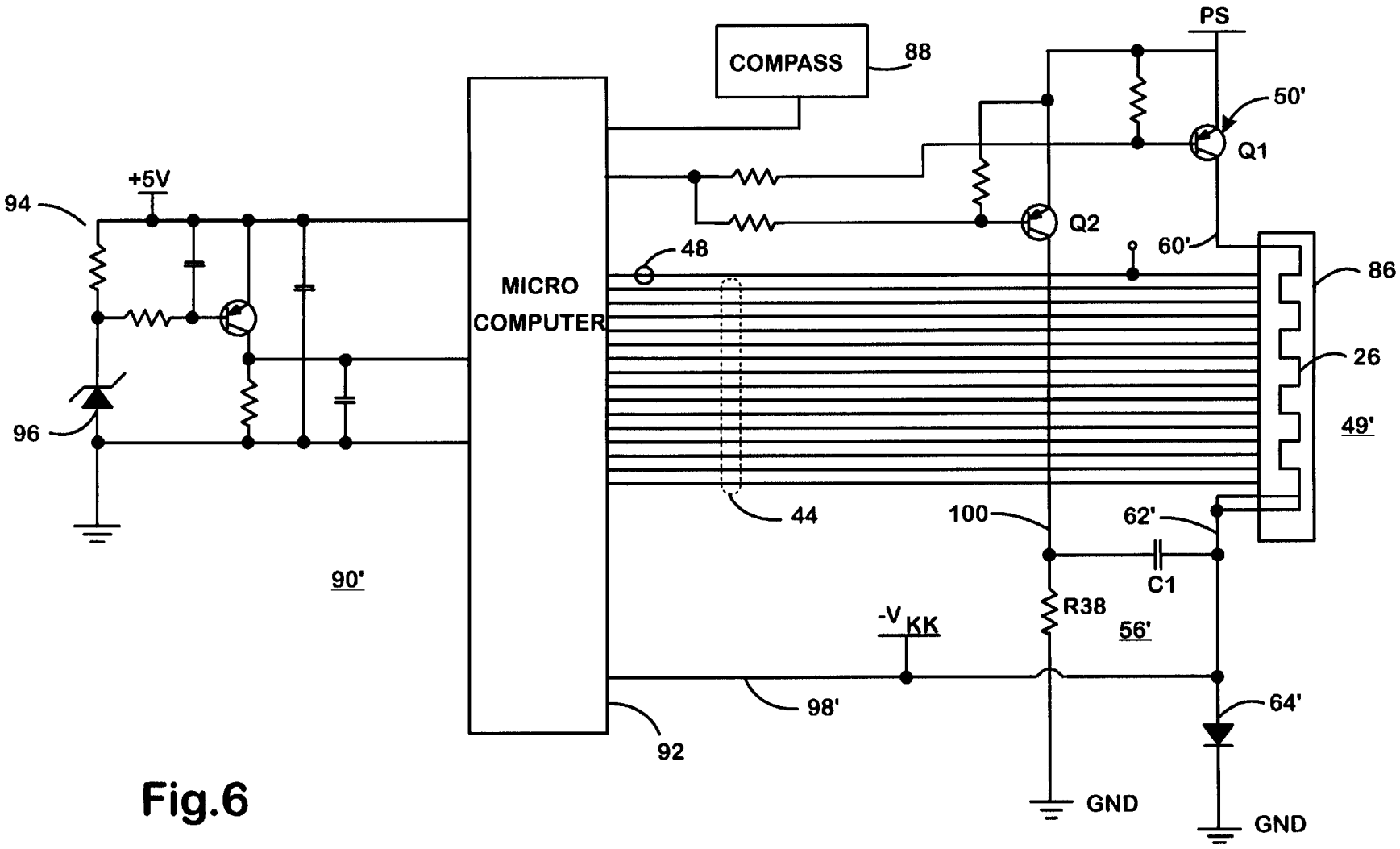
FIG. 6 is the same view as FIG. 5 of an alternative embodiment thereof.

In an alternative embodiment illustrated in FIG. 6, a compass mirror display system 90' includes a light-sensing circuit 94, a compass system 88, a display element 86, and a microcomputer 92, each of which may be the same as that illustrated with respect to display system 90. Compass mirror display system 90' also includes output lines 44 to enable microcomputer 92 to apply either a positive potential to particular segments in order to illuminate those segments or apply negative potential to segments in order to darken those segments. Likewise, a line 48 from microcomputer 92 allows microcomputer 92 to either apply a positive potential to the grid in order to turn the digit ON or a negative potential to the grid to turn the digit OFF. Compass mirror display system 90' includes a filament supply circuit 49' including a filament heat control 50' made up of a transistor Q1 whose emitter is connected with a positive potential source, whose collector is connected through terminal 90' to one terminal of the filament of the display element and whose base is connected through a resistor R32 to an output of microcomputer 92. The other terminal 62' of the filament is connected through a diode 64' to ground. The low-current negative potential source 56' also includes a transistor Q2 whose emitter is connected with the same positive potential source as transistor Q1 and whose base is driven through a resistor R36 by the same output which drives transistor Q1. The collector of transistor Q2 is connected at junction 100 with one lead of a capacitor C1 whose other lead is connected with terminal 62'. Junction 100 is connected through a resistor R38 to ground. Negative potential line 98' is fed as an input to microcomputer 92 in order to provide negative potential for clamping segments which are not to be lit to a negative potential and to the grid to cause the grid to turn the display off.

Compass mirror display system 90' operates as follows. During a minor portion of the duty cycle in which power is applied to the filament of display element 86, an output of microcomputer 92 drives transistors Q1 and Q2 into conduction. The resulting potential at junction 100 is more positive than the potential at terminal 62' which causes capacitor C1 to charge. At the end of the minor portion of the duty cycle, the output of microcomputer 92 is removed from the base of transistors Q1 and Q2 allowing the transistors to open circuit. When the transistors open circuit, there is no longer heat applied to the filament of display element 86 and junction 100 is no longer being supplied from source PS through transistor Q2. As a result, resistor R38 pulls junction 100 to ground potential and the potential across capacitor C1 pulls $-V_{KK}$ line 98' low to approximately −7 volts DC during the major portion of the duty cycle in order to bring filament 26 to a negative voltage to cause the selected segments of the display element 86 to light. The technique in compass mirror display system 90' is referred to as a capacitive bootstrap voltage multiplication system.

Figure 7:
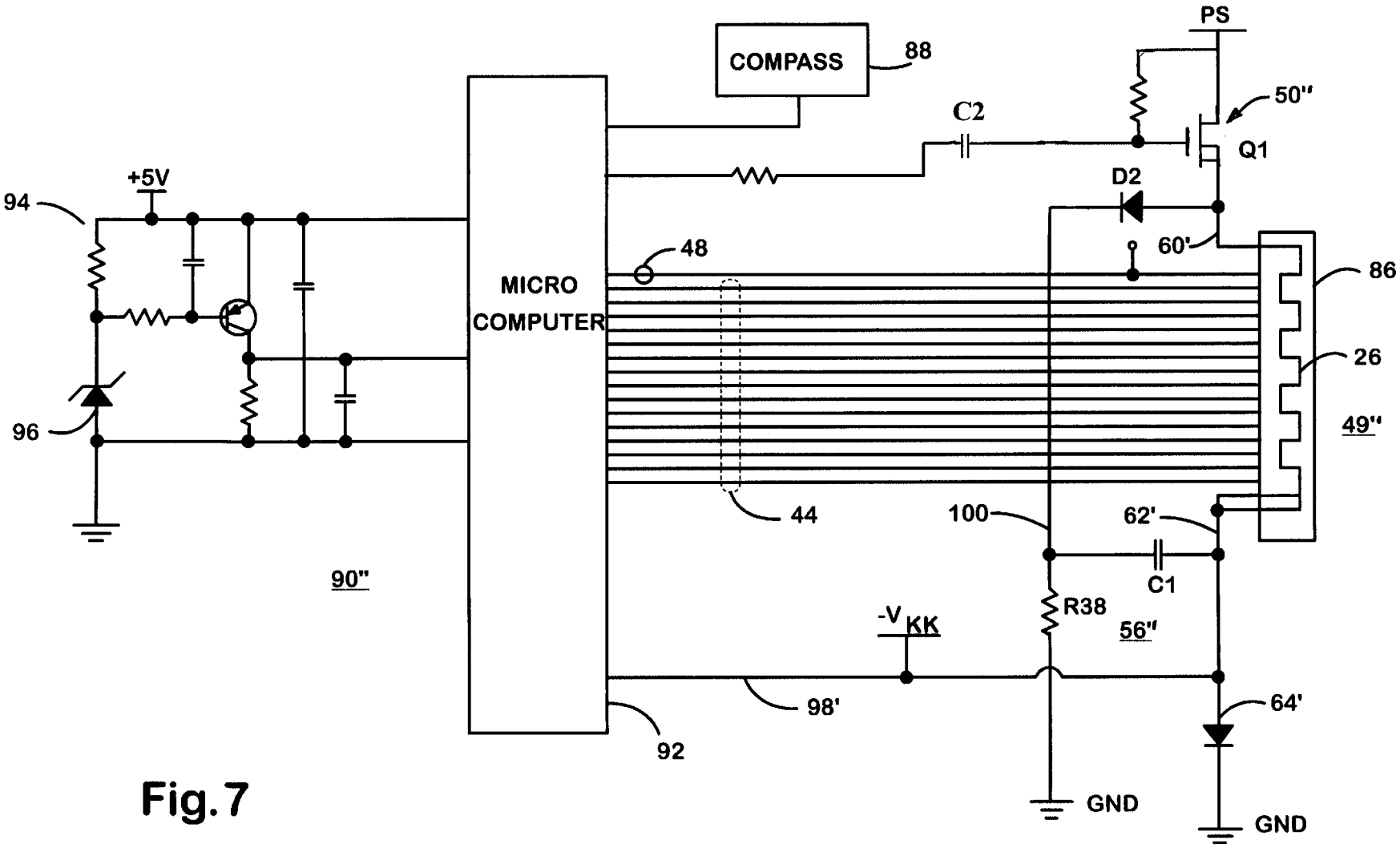
FIG. 7 is the same view as FIG. 5 of another alternative embodiment thereof.

Other techniques may be utilized to carry out the invention. For example, in a compass mirror display system 90" illustrated in FIG. 7, instead of using two transistors, a filament supply 49' includes a filament heat control 50" which uses a single type MNOS or a type PMOS field effect transistor (FET) Q1. Low current negative voltage circuit 56" includes a diode D2 connected between the source of FET Q1 and junction 100. Compass mirror display system 90" otherwise operates substantially the same as compass mirror display system 90'. While a diode is less expensive than a transistor, the increased load on transistor Q1 would require a stronger and, hence, more expensive switching device for Q1. FET Q1 could alternatively be a bipolar transistor in filament heater control 50".

Negative potentials can alternatively be produced using various techniques known to the skilled artisan. Without limitation, such other techniques include a capacitive voltage doubler and a charge pump voltage converter. Alternately, a DC—DC voltage converter, selected from one of many types known in the art, could be used to provide the negative voltage $-V_{KK}$. The pulsed filament technique then allows heating of the filament with a ground-isolated source.

Although the invention was illustrated with a display positioned behind a portion of a reflective element 72 where the reflective layer was removed, the display could be positioned on an "eyebrow" display portion of the housing above reflective element 72 or a "lip" portion of housing 74 below reflective element 72 as illustrated in U.S. Pat. No. 5,786,772, issued to Kenneth Schofield et al. entitled VEHICLE BLIND SPOT DETECTION DISPLAY SYSTEM, the disclosure of which is hereby incorporated herein by reference. The invention could also be applied to displays positioned in other portions of the vehicle, such as in overhead console applications, dashboard applications, exterior mirror applications, and the like.

Although the invention was illustrated in a compass mirror displaying vehicle heading, it could be used in other display mirror applications, such as to display inside or outside temperature, altitude/incline such as is useful in sport utility vehicles, engine functions, blind spot intrusion, or the like. The display could also alternate in displaying different parameters.

Although the invention was illustrated as applied to a seven-segment numerical display, it can also be applied to illuminating custom icons, such as icons to illustrate: seat belt unbuckled, emergency brake is on, air bag is disabled, blind spot intrusion, a circle with a line through it over the symbol, and the like.

The display driver disclosed in the present application is capable of operating a vacuum fluorescent display device at approximately 10 to 20 milliamps average current which is an approximate five-fold reduction in power requirement from conventional vacuum fluorescent display drivers. This is accomplished from a unipolar power supply without the requirement for a separate driver integrated circuit between the microcomputer and the vacuum fluorescent display. The duration of the minor portion of the duty cycle during which the filament is heated can be made adjustable. This varies the heat level of the filament which is capable of varying the intensity, or brightness, of the display. This may be used alone or in combination with PWM control of the segments and/or grid to control display intensity. Although the invention has been illustrated for use with a microprocessor-based system, its principles may be applied to discrete digital logic circuitry as well as to analog circuitry.

Changes and modifications in the specifically described embodiments can be carried out without departing from the principles of the invention, which is intended to be limited only by the scope of the appended claims, as interpreted according to the principles of patent law.

The embodiments of the invention in which an exclusive property or privilege is claimed are defined as follows:

1. A vacuum fluorescent display driver for driving a vacuum display device having a filament, a grid, and at least one illuminatable segment, comprising:

a segment selecting circuit which selectively applies an electrical potential of a particular polarity to a segment to illuminate that segment;

a grid driver circuit which applies an electrical potential of said particular polarity to the grid in order to illuminate the device; and a filament supply which supplies an electrical current to the filament during a first portion of a duty cycle in order to heat the filament and applies an electrical potential opposite said particular polarity to the filament during a second portion of the duty cycle in order to produce an electrical potential between the filament, the grid, and any segment to which said electrical potential of particular polarity is applied sufficient to light the selected segment.

2. The vacuum fluorescent display driver in claim 1 wherein said first portion of said duty cycle is less than approximately 50%.

3. The vacuum fluorescent display driver in claim 2 wherein said first portion of said duty cycle is less than approximately 20%.

4. The vacuum fluorescent display driver in claim 3 wherein said first portion of said duty cycle is between approximately 2% and approximately 5%.

5. The vacuum fluorescent display driver in claim 4 wherein said filament supply applies between approximately 5 volts DC and approximately 8 volts DC to the filament during said first portion of a duty cycle.

6. The vacuum fluorescent display driver in claim 1 wherein said filament supply applies between approximately 5 volts DC and approximately 8 volts DC to the filament during said first portion of a duty cycle.

7. The vacuum fluorescent display driver in claim 1 wherein said voltage opposite said particular polarity is produced by a voltage converter circuit.

8. The vacuum fluorescent display driver in claim 7 wherein said voltage converter circuit comprises an inductive flyback circuit.

9. The vacuum fluorescent display driver in claim 7 wherein said voltage converter circuit comprises a capacitive bootstrap circuit.

10. The vacuum fluorescent display driver in claim 1 wherein said duty cycle has a repetition rate of at least approximately 10 kHz.

11. The vacuum fluorescent display driver in claim 10 wherein said duty cycle has a repetition rate of between approximately 20 kHz and approximately 25 kHz.

12. The vacuum fluorescent display driver in claim 1 wherein said filament supply applies said electrical potential opposite said particular polarity to said segment selecting circuit which selectively applies said electrical potential opposite said particular polarity to a segment to darken that segment.

13. The vacuum fluorescent display driver in claim 1 wherein said filament supply applies said electrical potential opposite said particular polarity to said grid driver circuit which selectively applies said electrical potential opposite said particular polarity to the grid to darken the display element.

14. The vacuum fluorescent display driver in claim 1 wherein said duty cycle is variable in order to vary the heat level of the filament to control at least partially the intensity of the display.

15. A vacuum fluorescent display circuit, comprising:

a vacuum fluorescent display device having a filament, a grid and a plurality of display segments;

a microcomputer operable from a power supply of a particular polarity, said microcomputer having output ports connected with said segments and selectively activated by said microcomputer to illuminate particular segments of said display device, said microcomputer having an output port connected with said grid and selectively activated by said microcomputer to illuminate the display; and a filament supply circuit operated from said particular polarity under the control of said microcomputer for heating said filament and for driving said filament in an opposite polarity in order to produce an electrical potential between said filament and said grid sufficient to illuminate the activated segments.

16. The vacuum fluorescent display circuit in claim 15 wherein said filament supply circuit applies a current to the filament during a first portion of a duty cycle in order to heat the filament and produces an electrical potential opposite said particular polarity during a second portion of the duty cycle in order to produce an electrical potential between the filament and the grid to illuminate the device.

17. The vacuum fluorescent display circuit in claim 16 wherein said filament supply circuit includes an energy storage device and a switching circuit, wherein said switching circuit drives a current through said filament during said first portion of a duty cycle in order to heat the filament and to store energy in said energy storage device and wherein said switching circuit opens during said second portion of the duty cycle causing said energy storage device to produce an electrical potential of said opposite polarity.

18. The vacuum fluorescent display circuit in claim 16 wherein said energy storage device is an inductor and said filament driver circuit comprises a flyback circuit.

19. The vacuum fluorescent display circuit in claim 16 wherein said energy storage device is a capacitor and said filament driver circuit comprises a bootstrap circuit.

20. The vacuum fluorescent display circuit in claim 16 including a time limiter which limits the time duration said switching circuit can operate.

21. The vacuum fluorescent display circuit in claim 15 wherein said microcomputer receives an input from said filament supply circuit in order to apply said electrical potential opposite said particular polarity to segments to darken those segments and to apply said electrical potential opposite said particular polarity to said grid to at least intermittently darken the display.

22. The vacuum fluorescent display circuit in claim 15 wherein said duty cycle is variable in order to vary the heat level of the filament to control at least partially the intensity of the display.

23. The vacuum fluorescent display driver circuit in claim 16 wherein said first portion of said duty cycle is less than approximately 50%.

24. The vacuum fluorescent display driver circuit in claim 23 wherein said first portion of said duty cycle is less than approximately 20%.

25. The vacuum fluorescent display driver circuit in claim 24 wherein said first portion of said duty cycle is between approximately 2% and approximately 5%.

26. The vacuum fluorescent display driver circuit in claim 25 wherein said filament supply applies between approximately 5 volts DC and approximately 8 volts DC to the filament during said first portion of a duty cycle.

27. The vacuum fluorescent display driver circuit in claim 16 wherein said filament supply applies between approximately 5 volts DC and approximately 8 volts DC to the filament during said first portion of a duty cycle.

28. The vacuum fluorescent display driver circuit in claim 15 wherein said duty cycle has a repetition rate of at least approximately 10 kHz.

29. The vacuum fluorescent display driver circuit in claim 28 wherein said duty cycle has a repetition rate of between approximately 20 kHz and approximately 25 kHz.

30. A display mirror system for a vehicle having a positive voltage electrical supply system, comprising:

a reflective element having a reflective surface, a housing for said reflective element and a vacuum fluorescent display device in said housing for displaying information, said vacuum fluorescent display device having a filament, a grid and a plurality of display segments;

a microcomputer having at least one input port for receiving information to be displayed and output ports connected with said segments and selectively activated by said microcomputer to illuminate particular segments of said display device, said microcomputer having an output port connected with said grid and selectively activated by said microcomputer to illuminate the display; and a filament supply circuit under the control of said microcomputer for heating said filament and for driving said filament to an electrical potential of negative polarity in order to produce an electrical potential between said filament, said grid, and activated segments sufficient to illuminate the activated segments.

31. The display mirror system in claim 30 wherein said filament driver circuit applies a current to the filament during a first portion of a duty cycle in order to heat the filament and produces a negative voltage during a second portion of the duty cycle.

32. The display mirror system in claim 30 including a portion of said reflective surface that is at least partially removed, wherein said display device is positioned behind said portion.

33. The display mirror system in claim 30 wherein said display device is positioned in one of an eyebrow portion of the housing above said reflective element and a lip portion of the housing below said reflective element.

34. The display mirror system in claim 30 wherein said reflective element is an electro-optic device.

35. The display mirror system in claim 34 wherein said reflective element is an electrochromic device.

36. The display mirror system in claim 30 including a compass circuit in said housing which senses vehicle heading wherein said information displayed by said display device is vehicle heading.

37. The display mirror system in claim 31 wherein said filament supply circuit includes an energy storage device and a switching circuit, wherein said switching circuit drives a current through said filament during said first portion of a duty cycle in order to heat the filament and to store energy in said energy storage device and wherein said switching circuit opens during said second portion of the duty cycle causing said energy storage device to produce a voltage of said negative polarity.

38. The display mirror system in claim 37 wherein said energy storage device is an inductor and said filament driver circuit comprises a flyback circuit.

39. The display mirror system in claim 37 wherein said energy storage device is a capacitor and said filament driver circuit comprises a bootstrap circuit.

40. The display mirror system in claim 30 wherein said microcomputer receives an input from said filament supply circuit in order to apply said electrical potential of negative polarity to segments to darken those segments and to apply said electrical potential opposite said particular polarity to said grid to at least intermittently darken the display.

41. The display mirror system in claim 30 wherein said duty cycle is variable in order to vary the heat level of the filament to control at least partially the intensity of the display.

42. The display mirror system in claim 31 wherein said first portion of said duty cycle is less than approximately 50%.

43. The display mirror system in claim 42 wherein said first portion of said duty cycle is less than approximately 20%.

44. The display mirror system in claim 43 wherein said first portion of said duty cycle is between approximately 2% and approximately 5%.

45. The display mirror system in claim 44 wherein said filament supply applies between approximately 5 volts DC and approximately 8 volts DC to the filament during said first portion of a duty cycle.

46. The display mirror system in claim 31 wherein said filament supply applies between approximately 5 volts DC and approximately 8 volts DC to the filament during said first portion of a duty cycle.

47. The display mirror system in claim 31 wherein said duty cycle has a repetition rate of at least approximately 10 kHz.

48. The display mirror system in claim 47 wherein said duty cycle has a repetition rate of between approximate 20 kHz and approximately 25 kHz.

49. The display mirror system in claim 31 including a time limiter which limits the time duration said switching circuit can operate.

50. A method of operating a vacuum display device from a unipolar electrical source, the vacuum display device having a filament, a grid, and a plurality of illuminatable segments, including:

applying an electrical potential from the source to those segments which are to be illuminated;

applying an electrical potential from the source to the grid if the display is to be on;

applying an electrical current from the source to the filament during a minor portion of the duty cycle in order to heat the filament; and applying an electrical potential having a polarity opposite to the polarity of the source during a major portion of the duty cycle in order to produce an electrical potential between the filament, the grid, and those segments which are to be illuminated.

51. The method of claim 50 wherein said step of applying an electrical potential having a polarity opposite to the polarity of the source includes storing energy during said minor portion of the duty cycle in an energy storage device and using said energy storage device during said major portion of the duty cycle to produce a voltage having a polarity opposite to the polarity of the source.

52. The method of claim 51 wherein said energy storage device is an inductor and said using said energy storage device is carried out by a flyback circuit.

53. The method of claim 51 wherein said energy storage device is a capacitor and said using said energy storage device is carried out by a bootstrap circuit.

54. The method of claim 50 wherein said minor portion of the duty cycle is less than approximately 20%.

55. The method of claim 54 wherein said minor portion of the duty cycle is between approximately 3% and approximately 5%.

56. The method of claim 50 wherein said duty cycle has a repetition rate of at least approximately 10 kHz.

57. The method of claim 56 wherein said duty cycle has a repetition rate of between approximately 20 kHz and approximately 25 kHz.

58. The method of claim 50 including varying the duration of said portions in order to vary the heat level of the filament to control at least partially the intensity of the display.

* * * * *